United States Patent [19]

Kimbara

[11] 4,111,365

[45] Sep. 5, 1978

[54] FUEL INJECTION SYSTEM AND ITS NOZZLE HOLDER

[75] Inventor: Motoyasu Kimbara, Yokohama, Japan

[73] Assignee: Isuzu Motors Limited, Japan

[21] Appl. No.: 807,665

[22] Filed: Jun. 17, 1977 (Under 37 CFR 1.47)

Related U.S. Application Data

[63] Continuation of Ser. No. 663,805, Mar. 4, 1976, abandoned, which is a continuation of Ser. No. 534,890, Dec. 20, 1974, abandoned.

[30] Foreign Application Priority Data

Dec. 26, 1973 [JP] Japan ..... 49-3750
Dec. 28, 1973 [JP] Japan ..... 49-467

[51] Int. Cl.[2] ..... B05B 1/30

[52] U.S. Cl. ..... 239/93; 239/95; 239/533.3

[58] Field of Search ..... 239/95, 88, 92, 591, 239/533.1, 533.2, 533.3, 93

[56] References Cited

U.S. PATENT DOCUMENTS

| | | | |
|---|---|---|---|
| 2,627,254 | 2/1953 | De Juchasz | 239/95 X |
| 3,409,225 | 11/1968 | Maddalozzo et al. | 239/95 X |
| 3,662,959 | 5/1972 | Sample, Jr. | 239/533 |

FOREIGN PATENT DOCUMENTS

| | | | |
|---|---|---|---|
| 843,188 | 5/1952 | Fed. Rep. of Germany | 239/533 |
| 236,123 | 11/1969 | U.S.S.R. | 239/533 |

*Primary Examiner*—Joseph F. Peters, Jr.
*Assistant Examiner*—Michael Mar
*Attorney, Agent, or Firm*—McGlew and Tuttle

[57] ABSTRACT

A fuel injection system comprises a cam, an injection pump, a delivery valve, an injection pipe, a nozzle holder, and a nozzle. The fuel oil passage in the nozzle holder is reduced in diameter as compared with the inside diameter of the injection pipe, with the ratio F3/F1, or the ratio of the effective flow-passage cross sectional area F3 of the fuel oil passage to that F1 of the injection pipe, ranging from about 0.5 to 0.15, over the length *l* of the fuel oil passage which is 90 to 30 times the inside diameter of the injection pipe, so that the fluctuation of fuel pressure in the injection pipe is converted to kinetic energy thereby to control abnormalities of fuel injection. The long and narrow fuel oil passage in the nozzle holder is formed by inserting a hollow synthetic resin rod having a small-diameter center hole into an arial bore in the holder body, or by pouring molten synthetic resin into the axial bore and then forming the hole therein on solidification, or by placing a core wire concentrically and pouring molten synthetic resin into the bore and then pulling out the core from the solidified resin.

2 Claims, 5 Drawing Figures

FUEL INJECTION SYSTEM AND ITS NOZZLE HOLDER

This is a continuation of application Ser. No. 663,805 filed Mar. 4, 1976, now abandoned, which is in turn a continuation of Ser. No. 534,890 filed Dec. 20, 1974, now abandoned.

FIELD AND BACKGROUND OF THE INVENTION

This invention relates to a fuel injection system, and more specifically to an injection system capable of preventing abnormal operations such as secondary or non-uniform fuel injection.

A conventional fuel injection system, as shown in FIG. 1, comprise a cam 1, an injection pump 2, a delivery valve 3, an injection pipe 4, a nozzle holder 5, and a nozzle 6.

Injection system made up of these components are known to undergo, during their operation, more or less fuel pressure fluctuations as typically represented in a graph in FIG. 2 which originally appeared in "New Handbook for Automotive Engineers" (edited by Society of Automotive Engineers of Japan, Inc.). Of the pressure-fluctuating factors, the reflection waves indicates at W are primarily responsible for the abnormal injection.

The mechanism for developing the reflection waves W is as follows. At the end of fuel injection a recess 23 of the plunger 21 communicates with a fuel port 24 of the pump barrel 22 to release the fuel pressure. A needle valve 61 is consequently forced by a spring 62 to close the nozzle orifice 63. At this point, the delivery valve 3 acts to suck the fuel back, so that the fuel pressure drops from the maximum $P_1$ to the minimum $P_2$ level within a very short period of time. This drastic pressure change is transmitted to and from the nozzle 6 to produce reflection waves W.

If the amplitude of the reflection wave motion is so wide that the valve opening pressure $P_3$ is exceeded as indicated by a broken line in FIG. 2, the needle valve will again be opened for irregular fuel injection. Also, if the reflection wave is not appropriately damped and a proper residual pressure $P_4$ is not maintained, hunting or knocking may result.

SUMMARY OF THE INVENTION

It is an object of the present invention to provide a fuel injection system capable of preventing the aforedescribed abnormal operations such as secondary or non-uniform fuel injection.

Another object of the invention is to provide an improved nozzle holder for a fuel injection system capable of preventing the abnormalities such as secondary or non-uniform fuel injection.

BRIEF DESCRIPTION OF THE DRAWINGS

These and other objects, features and advantages will become more apparent from the following description taken in conjunction with the accompanying drawings, wherein.

DESCRIPTION OF THE PREFERRED EMBODIMENTS

Figure 1:
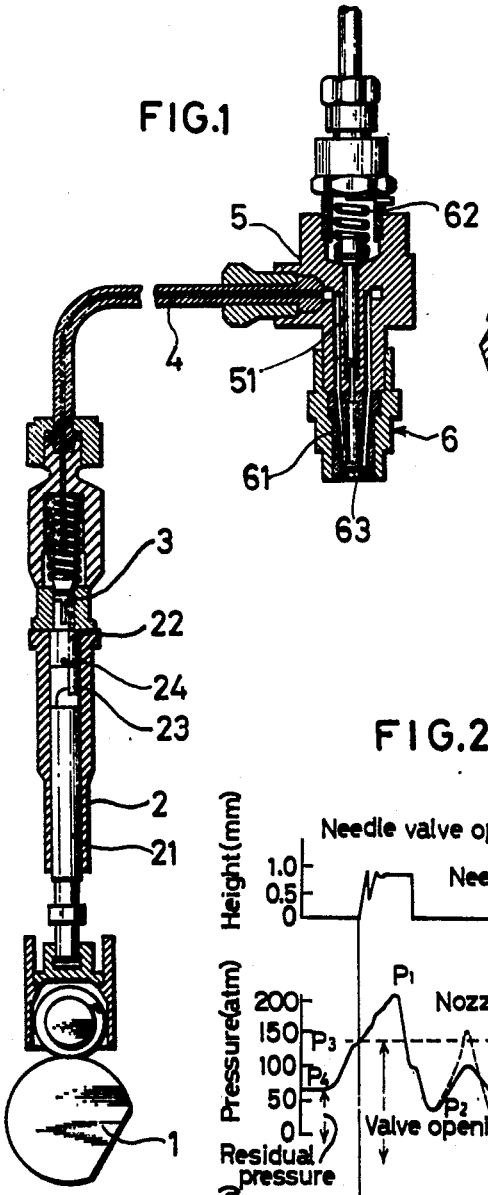
FIG. 1 is a sectional view of a conventional fuel injection system.

As noted, the irregularities in injection are caused by the reflection waves due to the sharp pressure drop (from $P_1$ to $P_2$) at the end of each injection. This means that the irregularities can be smoothed out by properly controlling such pressure drops. Avoidance of the sharp pressure drop on the nozzle side and damping of the reflection waves should be made possible through conversion of the pressure fluctuations (pressure energy) on the injection pump side into kinetic energy and through transmission of the energy to the nozzle.

The foregoing will now be theoretically discussed, on the basis of Bernoulli's theorem according to which the sum of pressure energy and kinetic energy is constant and also in view of the principle of continuity teaching that the volume of a fluid flowing between two points is constant, too. Now, designating by Fd the cross sectional area of the injection pipe 4 at the inlet of the nozzle holder 5, Pd and Vd the power output and velocity, respectively, of the fuel that passes the inlet, Fn the cross sectional area of the fuel oil passage 51 at the outlet of the nozzle holder, and Pn and Vn the pressure and velocity of fuel flowing down through the outlet, the fuel density $\rho$ being constant, the following relations hold:

$$Pd + \tfrac{1}{2}\cdot\rho Vd^2 = Pn + \tfrac{1}{2}\cdot\rho\cdot Vn^2 \quad (1)$$

$$Fd\cdot Vd = Fn\cdot Vn \quad (2)$$

Thus, a change in the pressure energy can be converted to that of kinetic energy by suitably reducing the cross sectional area F*n* of the fuel oil passage 51 with respect to that F*d* of the injection pipe 4. The energy conversion will lead to prevention of the sharp pressure drop and will thereby calm the reflection waves W.

Figure 3:
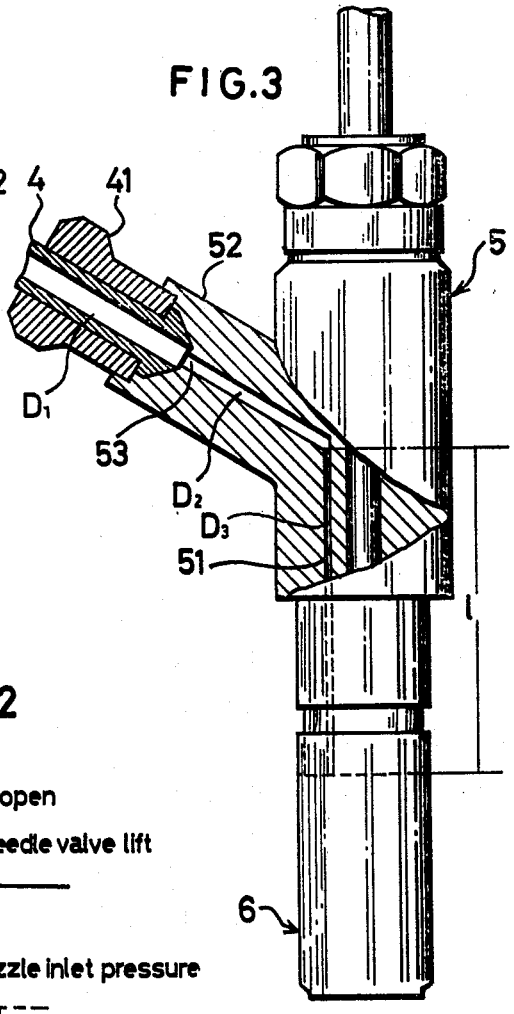
FIGS. 3 to 5 are enlarged views, partly in section, of a few embodiments of the invention.
Figure 2:
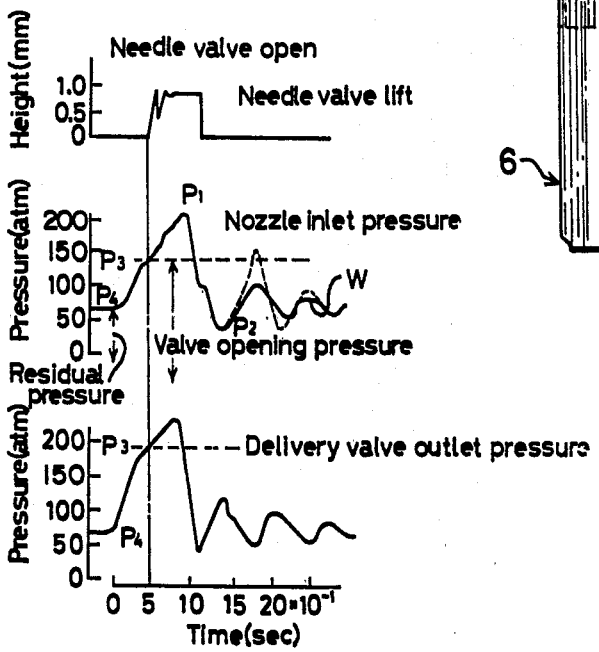
FIG. 2 is a graph showing the fuel pressure fluctuations inside an ordinary fuel injection system.
Figure 4:
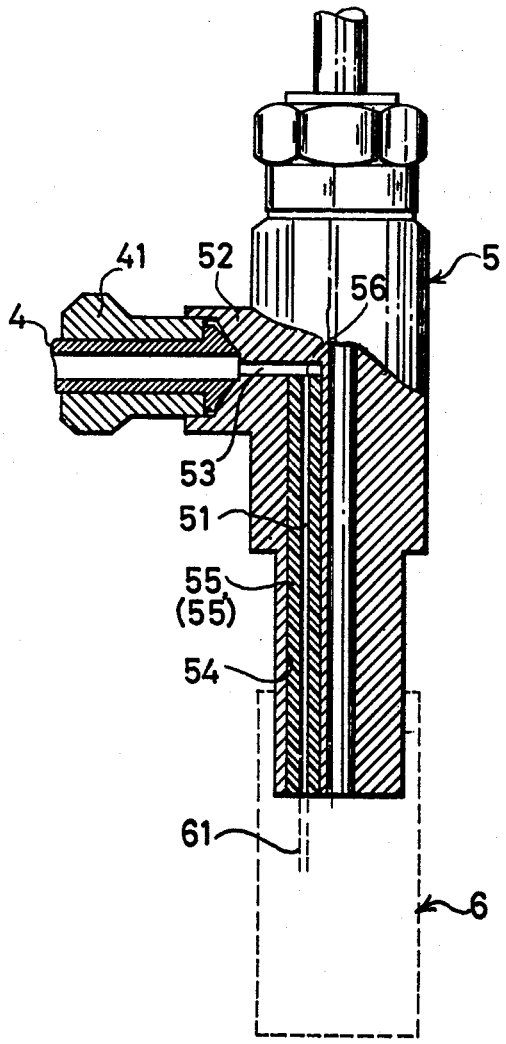
Figure 5:
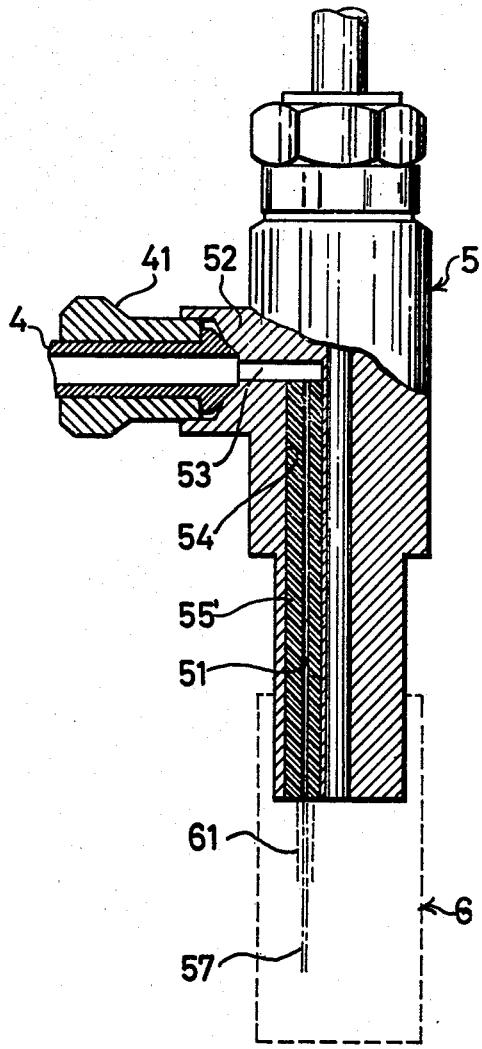

Such are the theoretical grounds upon which the present invention is based. The invention will now be described with reference to FIGS. 3 to 5 showing different embodiments thereof. In FIG. 3, an injection pipe 4 is connected to an adapter 52 of a nozzle holder 5 through a joint 41. A center passage 53 of the adapter communicates with a fuel oil passage 51. The inside diameter $D_1$ of the injection pipe 4, the diameter $D_2$ of the adapter passage 53, and the diameter $D_3$ of the fuel oil passage 51 are in the relationship of $D_1 > D_2 > D_3$. In other words, the entire fuel passage is gradually reduced in diameter to preclude a sharp change in the flow velocity Vn. Experiments have indicated that a good result is obtained when the passage 51 of the nozzle holder 5 is within an area reduction ratio (or the ratio of the effective cross sectional area of the fuel oil passage 51 $F_3 = \frac{1}{4}\pi D_3^2$ to that of the injection pipe 4 $F_1 = \frac{1}{4}\pi D_1^2$) $F_3/F_1$ of from about 0.5 to about 0.15. Further, the length $l$ of the fuel oil passage 51 to be thus reduced in cross sectional area is preferably from 90 to 30 times the inside diameter $D_1$ of the injection pipe 4. If the area reduction ratio or the length of area reduction exceeds the specified range, the fuel flow rate necessary for the maximum power output of the engine will no longer be secured. Conversely if either range is not reached, the reflection waves will not be adequately damped. The beneficial effect of cross sectional area reduction thus depends not only on the ratio $F_3/F_1$ but also upon the length $l$ of the passage 51. For the best result, therefore, it is only necessary to choose experimentally optimum values for the particular engine from the ranges of the area reduction ratio and the length of the reduction specified above so as to obtain the most adequate combination of those values.

As has been described, the gradual reduction in diameter of the passage 51 in the nozzle 5 is effective as a means for damping the reflection waves. For example, if the diameter of the passage 51 is about 75 to 40% of the inside diameter of the injection pipe 4, the reflection waves will be calmed and no irregular fuel injection will take place.

Actually the fuel oil passage 51 is at least several tens of millimeters in length and is sometimes as long as one hundred and several ten millimeters. This makes it highly difficult to form the passage according to the invention by conventional drilling. For example, if the injection pipe 4 is about 2 mm in inside diameter, the diameter of the passage 51 must be between about 1.5 and 0.8 mm. The passage will then be too small and too long for machining and mass production of the nozzle holder 5.

The present invention is directed to the provision of means for overcoming the above difficulty, and more particularly to the provision of means for easily forming a narrow and long fuel oil passage by inserting a hollow synthetic resin rod with a fine center hole into a large bore of a nozzle holder, instead of by resorting to the difficult drilling of the metallic holder body directly to form the passage therein.

The invention also provides means for forming a fuel oil passage by pouring molten synthetic resin into the bore of a nozzle holder and then forming a long, small-diameter hole in the solidified filler material, instead of by the direct drilling of the nozzle holder body.

Further, the invention provides means for forming a long, small-diameter fuel oil passage by pouring molten synthetic resin into a large bore of a nozzle holder preloaded with a fine core wire and then drawing the core wire out of the solidified-resin, instead of directly drilling the nozzle holder body.

The embodiments shown in FIGS. 4 and 5 will now be described.

Referring to FIG. 4, an injection pipe 4 is connected to an adapter 52 of a nozzle holder 5 through a joint 41, and a passage 53 in the adapter communicates with an axial bore 54 of the nozzle holder. A hollow synthetic resin rod 55 having a small-diameter hole in the center is fitted into the axial bore 54. The hollow or center hole 56, which serves as the fuel oil passage 51, communicates with the fuel passage 61 of the nozzle 6.

Synthetic resins, in general, are highly machinable to close dimensional tolerances, and therefore the rod 55 with the center hole 56 to constitute the fuel oil passage 51 can be made with good accuracy and in a simple and inexpensive way. Of course, hollow rods having center holes as small as 1.5 to 0.8 mm in diameter are fabricated with no difficulty.

Thus, according to the present invention, a very long and narrow fuel oil passage 51 is formed by inserting a rod 55 having the very small center hole 56 into the axial bore 54 preformed in the nozzle holder 5 in communication with the fuel passage 61 of the nozzle and the injection pipe 4. The axial bore 54 of the nozzle holder is formed by drilling with ease, because it has only to receive the hollow rod and may be as large as or even larger in diameter than the injection pipe 4.

Alternatively, as also shown in FIG. 4, the fuel oil passage 51 may be formed by pouring molten synthetic resin 55' into the axial bore 44 and, after it has solidified, drilling the resulting rod to form a small-diameter hole therethrough.

Since synthetic resins are easier to machine than cast iron of which the nozzle holder 5 is made, the machining load on the drill is negligible when the very long, small-diameter passage is formed. No difficulty is involved in producing the passage ranging in diameter from 1.5 down to 0.8 mm.

As described, in accordance with the invention, a very long and narrow fuel oil passage 51 is obtained by first forming an axial bore 54 in the nozzle holder 5, in communication with the fuel passage 61 of the nozzle and the injection pipe 4, pouring molten synthetic resin 55' into the bore, and then, on solidification of the resin, drilling the resulting rod concentrically with the bore. There is no necessity of directly drilling the cast iron body of the nozzle holder, and the machining is excellently performed. The work is made easy by the fact that the axial bore may be relatively large in diameter. In this way a nozzle holder having a very long, small-diameter fuel oil passage is manufactured easily at low cost.

Another embodiment shown in FIG. 5 is made by pouring molten synthetic resin 55 into an axial bore 54 wherein a fine core wire 57 is placed in advance, and drawing out the wire after the solidification of the resin leaving a corresponding hole behind which is to constitute a fuel oil passage 51.

Desirably, the fine core wire 57 is a drawn steel wire such as piano wire. Such a wire may generally be made very slender to ensure sufficiently high machining accuracy for the purpose of the invention. Therefore, pulling off the core of such a material from the synthetic resin 55' leaves behind a correspondingly long, small-diameter hole with desirable dimensional accuracy.

Thus, according to the invention, an axial bore 54 in communication with the fuel passage of the nozzle holder and the injection pipe is formed beforehand in the nozzle holder, a fine core wire 57 is inserted concentrically in the axial bore, molten synthetic resin 55' is poured into the bore, and then the core wire is drawn out, leaving a very long, small-diameter fuel oil passage behind in the solidified resin. This procedure eliminates the necessity of drilling and permits a fuel oil passage of a desired diameter to be formed with utmost ease. Although the nozzle holder 5 itself must be drilled to make the axial bore, the machining operating involves no technical difficulty since its diameter may be equal to or greater than that of the injection pipe 4 so as to receive the synthetic resin.

As has been described hereinabove, the present invention teaches that, if the fuel oil passage in the nozzle holder is suitably reduced in diameter progressively from the inside diameter of the injection pipe and if the length of the passage is adequately chosen, change of pressure in the injection pipe 4 due to the operation of the injection pump 2 and the delivery valve 3 will be converted to that of kinetic energy and transmitted as such to the nozzle 6. This precludes the development of reflection waves (or damps the amplitude of the fluctuations) which may otherwise result from a sharp drop of the fuel injection pressure (from $P_1$ to $P_2$). Hence there is no abnormal fuel injection. Because the pressure fluctuation in the nozzle 6 is accordingly decreased, the behavior of the needle valve becomes stable and effects smooth fuel injection. This is helpful, in addition, in controlling engine knocking, hunting, and smoky emissions.

In brief, according to the invention, the nozzle holder of a fuel injection system is provided with an extremely long and narrow fuel oil passage easily and inexpensively, by inserting a hollow synthetic resin rod having a small-diameter center hole into an axial bore of the nozzle holder body, or pouring molten synthetic resin into the axial bore and then drilling the solidified resin to form a small-diameter hole, or by placing a core wire and pouring molten synthetic resin into the bore and then pulling the core out of the solidified resin.

What is claimed is:

1. In a fuel injection system of the type including a nozzle, having a fuel discharge orifice and a fuel-receiving passage communicating with the orifice, and a nozzle holder coupled at one end to the nozzle and having a fuel flow passage communicating with the fuel-receiving passage of the nozzle, a needle valve controlling the nozzle orifice, and an adapter having an adapter passage communicating with the fuel flow passage, and further including a fuel injection pipe coupled to the adapter and communicating with the adapter passage, a cam-operated injection pump, and a delivery valve connecting the pump to the injection pipe to inject fuel into the fuel flow passage in the nozzle holder for delivery to the fuel receiving passage of the nozzle, the improvement comprising said fuel flow passage extending only in said nozzle holder and being a greatly elongated, small diameter passage communicating at one end with said adapter passage and terminating at the end of said nozzle holder coupled to said nozzle; said fuel flow passage in said nozzle holder being reduced in diameter, with the ratio $F_3/F_1$, when $F_3$ is the flow cross-sectional area of said injection pipe, ranging from about 0.5 to 0.15, over the length of said fuel flow passage which length, in said nozzle holder, is 90 to 30 times the inside diameter $D_1$ of said injection pipe, so that the fluctuation of fuel pressure in said injection pipe is converted to kinetic energy in said fuel flow passage, thereby to control abnormalities of fuel injection.

2. A fuel injection system according to claim 1, wherein said nozzle holder has an axially extending bore therethrough in communication with said fuel-receiving passage of said nozzle and said adapter passage, and a long hollow synthetic resin rod, having a very small-diameter bore extending longitudinally therethrough, positioned in said axially extending bore, the bore in said resin rod constituting said very long small-diameter fuel flow passage.

* * * * *